US008244535B2

(12) United States Patent
Hubner et al.

(10) Patent No.: US 8,244,535 B2
(45) Date of Patent: Aug. 14, 2012

(54) AUDIO FREQUENCY REMAPPING

(75) Inventors: Paul V. Hubner, McKinney, TX (US); Kristopher A. Pate, Sachse, TX (US); Steven T. Archer, Dallas, TX (US); Robert A. Clavenna, Lucas, TX (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 936 days.

(21) Appl. No.: 12/252,058

(22) Filed: Oct. 15, 2008

(65) Prior Publication Data

US 2010/0094619 A1 Apr. 15, 2010

(51) Int. Cl.
*G10L 13/08* (2006.01)

(52) U.S. Cl. ..... 704/260; 375/264; 381/312; 381/316; 381/320; 455/550.1; 455/90.1; 704/225; 704/271; 704/503

(58) Field of Classification Search ..... 455/90.1, 455/550.1; 375/264; 381/312, 316, 320; 704/225, 271, 503
See application file for complete search history.

(56) References Cited

U.S. PATENT DOCUMENTS

| | | | | |
|---|---|---|---|---|
| 5,418,818 | A * | 5/1995 | Marchetto et al. | 375/264 |
| 5,659,594 | A * | 8/1997 | Toda | 455/550.1 |
| 6,173,062 | B1 * | 1/2001 | Dibachi et al. | 381/312 |
| 6,192,341 | B1 * | 2/2001 | Becker et al. | 704/271 |
| 6,842,735 | B1 * | 1/2005 | Covell et al. | 704/503 |
| 6,944,474 | B2 * | 9/2005 | Rader et al. | 455/550.1 |
| 7,483,831 | B2 * | 1/2009 | Rankovic | 704/225 |
| 8,031,892 | B2 * | 10/2011 | Andersen et al. | 381/316 |
| 2004/0264721 | A1 * | 12/2004 | Allegro et al. | 381/316 |
| 2007/0230729 | A1 * | 10/2007 | Naylor et al. | 381/320 |
| 2008/0254753 | A1 * | 10/2008 | Steenstra et al. | 455/90.1 |
| 2009/0226015 | A1 * | 9/2009 | Zeng et al. | 381/316 |

* cited by examiner

*Primary Examiner* — Michael Colucci

(57) ABSTRACT

An exemplary system and method are directed at receiving an audio signal and process the audio signal into a remapped audio signal based on a plot profile. The plot profile may include at least one of an identified range of audio frequencies. The processing may comprise retrieving an identified range of audio frequencies from the plot profile; determining a range of impaired audio frequencies in the audio signal based on the identified range of audio frequencies; shifting the frequency of at least a portion of the impaired audio frequencies to outside of the identified range; and continuing to retrieve identified ranges of audio frequencies from the plot profile. The shifting of the impaired audio frequencies of the audio signal may be performed until no further identified ranges of audio frequencies are available for consideration.

24 Claims, 9 Drawing Sheets

Frequency Remapping and Compression Function

Frequency Remapping and Compression Function

Frequency Remapping Without Compression Function

Frequency Shifting of Transmitted Signal

AUDIO FREQUENCY REMAPPING

BACKGROUND

Telecommunications can require a user to clearly interpret sounds generated by his or her communications device. For a hearing impaired user, sound interpretation can range from a minor annoyance to a near impossibility, depending on the user's level of impairment. Additionally, speakers whose voices lie outside of a standard frequency range, e.g. adults or children with a high-pitched voice or who speak with a particularly wide frequency range, can be more difficult to interpret. In such cases, both human and automated receivers are prone to difficulty in understanding the audio information.

Accordingly, selective remapping of sound frequencies to a new range, based either on an individual's hearing needs, or compression to a generalized standard vocal range (i.e. for auto attendants, speech recognition software, and the like), can make sound interpretation more accurate.

DETAILED DESCRIPTION

Figure 1:
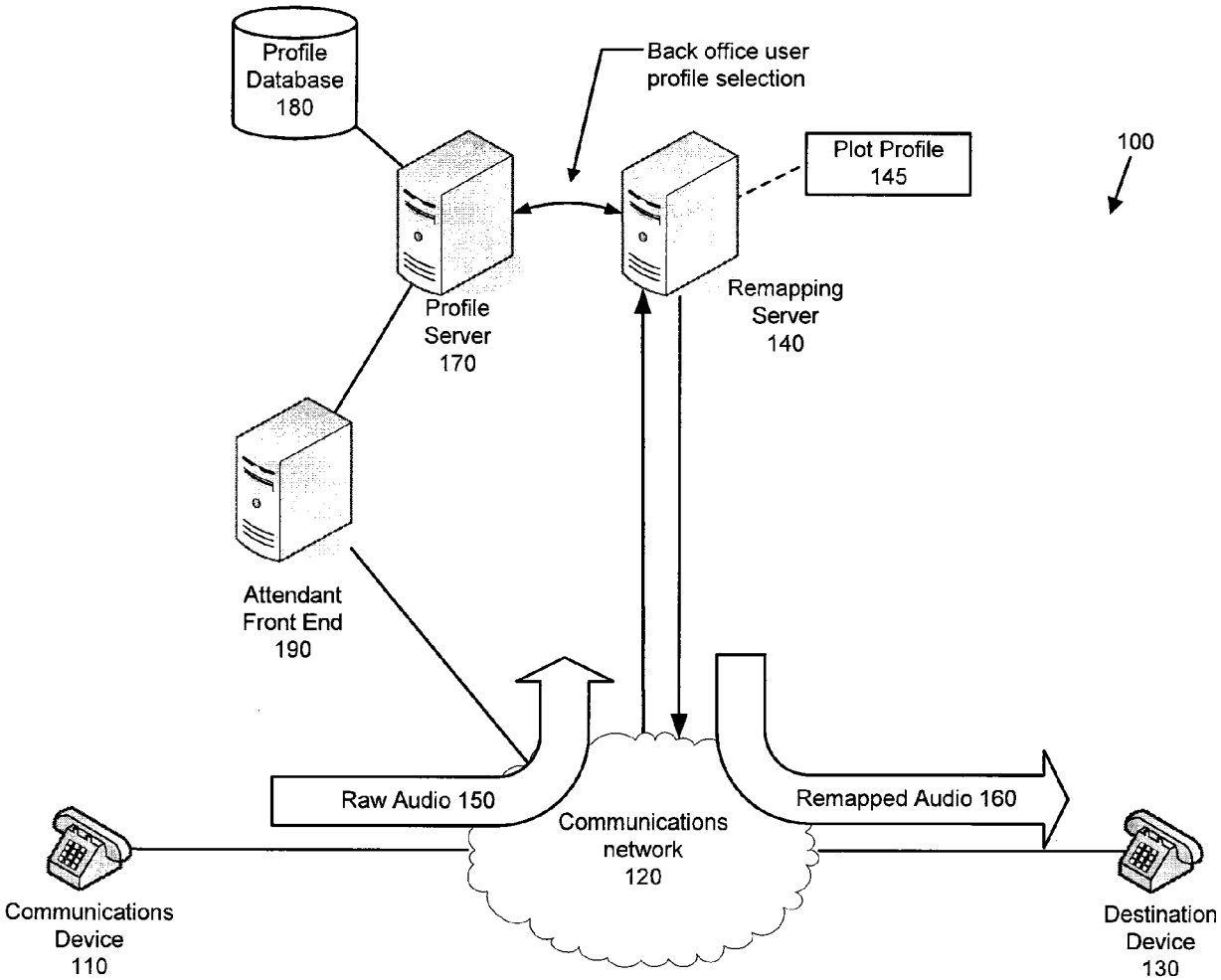
FIG. 1 illustrates an exemplary communications system for dynamically remapping raw audio frequencies, sent to or from a communications device, into another audio frequency range.

FIG. 1 illustrates an exemplary communications system (system) 100 for dynamically remapping raw audio frequencies, sent to or from a communications device, into another audio frequency range. System 100 may take many different forms and include multiple and/or alternate components and facilities. While an exemplary system 100 is shown in FIG. 1, the exemplary components illustrated in the Figure are not intended to be limiting. Indeed, additional or alternative components and/or implementations may be used.

The system 100 may enhance an audio experience for a hearing impaired user (e.g. a human, a machine, etc.) using existing and standard telecommunications infrastructure and devices. This is accomplished by adjusting a raw audio 150 signal into a remapped audio 160 signal within a hearing range more readily understood by a user. The audio signal before processing is the raw audio 150 signal, and the audio signal after processing is the remapped audio 160 signal. For example, the system 100 may remap a raw audio 150 signal to shift frequencies out of a user's impaired hearing range (examples of hearing impairments include hearing loss, deafness, tinnitus, ringing, etc.). As another example, the system 100 may remap the speech of a user who has a very high voice into a more acceptable frequency range for an auto-attendant system.

In addition, the system 100 may also benefit a non-impaired user operating within an impaired environment. Preset modes may be used to remap raw audio 150 as appropriate to situations where a normal user would have a hard time hearing. For example, during a voice call from within a boisterous crowd at a sporting event, one might personally find lowering the frequency 20% improves perceived clarity. As another example, remapping to a 30% higher frequency range might make an audio signal more intelligible when received in a rumbling machine shop.

As illustrated in FIG. 1, system 100 includes a communications device 110. A communications device 110 (e.g. POTS telephone, VOIP telephone, mobile telephone, "softphone," pager, computer, Set Top Box (STB), etc.) is used by a user to send and receive communications signals (e.g. audio, video, etc.) on a communications network 120 (e.g. PSTN, VOIP, cellular telephone, etc.). Likewise, a communications network 120 may provide communications services, including packet-switched network services (e.g., Internet access and/or VOIP communication services) to at least one communications device 110. Each communications device 110 on the communications network 120 may have its own unique device identifier (e.g. telephone number, Common Language Location Identifier (CLLI) code, Internet protocol (IP) address, input string, etc.) which may be used to indicate, reference, or selectively connect to a particular device on the communications network 120.

A destination device 130 is a communications device 110 on a communications network 120 to which a communications device 110 may selectively connect. Once a communications device 110 is connected to another device (e.g. destination device 130) through the communications network 120, the communications device 110 may then be used to send and receive communications signals (e.g. audio, video) with the destination device 130. For example, a raw audio 150 signal is a type of communication signal, composed of an audio signal encoded for transmission across the communications network 120. The raw audio 150 signal may be encoded and transmitted as either an analog or a digital signal, as is well known.

A remapping server 140 may be used to transform raw audio 150 signals into remapped audio 160 signals. In many examples, the remapping server 140 is a computing device, including a processor, and storage. In general, a processor (e.g., a microprocessor) receives instructions, e.g., from a memory, a computer-readable medium, etc., and executes these instructions, thereby performing one or more processes, including one or more of the processes described herein. Such instructions may be stored and transmitted using a variety of known computer-readable media.

In some examples, a remapping server 140 may be implemented as computer-readable instructions (e.g., software) on one or more computing devices (e.g., servers, personal computers, etc.).

A computer-readable medium (also referred to as a processor-readable medium) includes any tangible medium that participates in providing data (e.g., instructions) that may be read by a computer (e.g., by a processor of a computer). Such a medium may take many forms, including, but not limited to, non-volatile media, volatile media, and transmission media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Transmission media may include or convey acoustic waves, light waves, and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

In any event, the remapping server 140 may process raw audio 150 signals from communications network 120 into remapped audio 160 signals that may be received by a destination device 130. The remapping server 140 may also process raw audio 150 signals from the destination device 130 into remapped audio 160 signals for use by communications device 110 (a reverse flow not shown in FIG. 1 to maintain clarity). In the case of a communications network 120 utilizing analog audio signals, the remapping server 140 may also translate an analog audio signal into a digital audio signal for processing (e.g. via PCM, ADPCM, etc.), process the digital audio signal, and then translate the digital audio signal back to an analog signal for further transmission through the communications network 120.

In various exemplary implementations, the remapping server 140 uses a plot profile 145 to process the audio signal. A plot profile 145 may include at least one identified range of impaired audio frequencies within an audio signal (e.g. due to hearing loss, deafness, tinnitus, ringing, etc.). A plot profile 145 may also include at least one preset frequency offset (e.g. deepen voice 10%, lower than 3500 Hz, increase volume at trained frequencies). The plot profile 145 may thus be used by a remapping server 140 to indicate which audio frequencies within a raw audio 150 signal to map to other frequencies. For each area of impaired frequency response, the sounds within the impaired area may be moved to an area of less impairment (e.g. by being remapped and compressed, by being shifted in frequency without compression, etc.). Remapping of audio signals is discussed in more detail below with regard to FIGS. 3A, 3B, and 4.

The plot profile 145 may be a predefined standard/industry profile (e.g. senior citizen, noisy shop floor environment), or it may be a custom profile created for or by a particular user (e.g., a profile including a user's specific hearing range and impairments). Additionally, the system 100 may allow a user may create a custom plot profile 145, discussed in more detail below with regard to FIGS. 5 and 6. A plot profile 145 may be cached local to the remapping server 140, or may be retrieved from a profile server 170.

A profile server 170 selectively provides plot profiles 145 to a remapping server 140 for use in remapping a raw audio 150 signal. Profile server 170 generally includes a processor and a memory, as well as a computer readable medium such as a disk or the like for storing data, e.g., plot profiles 145, to be provided to remapping server 140. A profile database 180 may be included within profile server 170, or may be part of a separate computing system. In any event, profile server 170 is generally configured to selectively retrieve information from profile database 180 in response to requests for plot profiles 145. Additionally, profile server 170 is configured to store a plot profile 145 to be retrieved later by a user for use in remapping a raw audio 150 signal in conformance with the user's stored plot profile 145.

An attendant front end 190 may provides a user interface for a user of a communications device 110 to select a plot profile 145 from profile server 170 for use by remapping server 140 in the processing of raw audio 150 signal into remapped audio 160 signal. For example, an automatic attendant front end 190 may answer a call, prompt for a numeric code indicating a desired plot profile 145 to be used for the call, inform a profile server 170 to selectively retrieve the plot profile 145, and indicate to a remapping server 140 of the user's plot profile 145 selection. The indicated plot profile 145 may remain in use for the next call only, or may stay associated with a communications line or a user until another plot profile 145 is selected.

Figure 2:
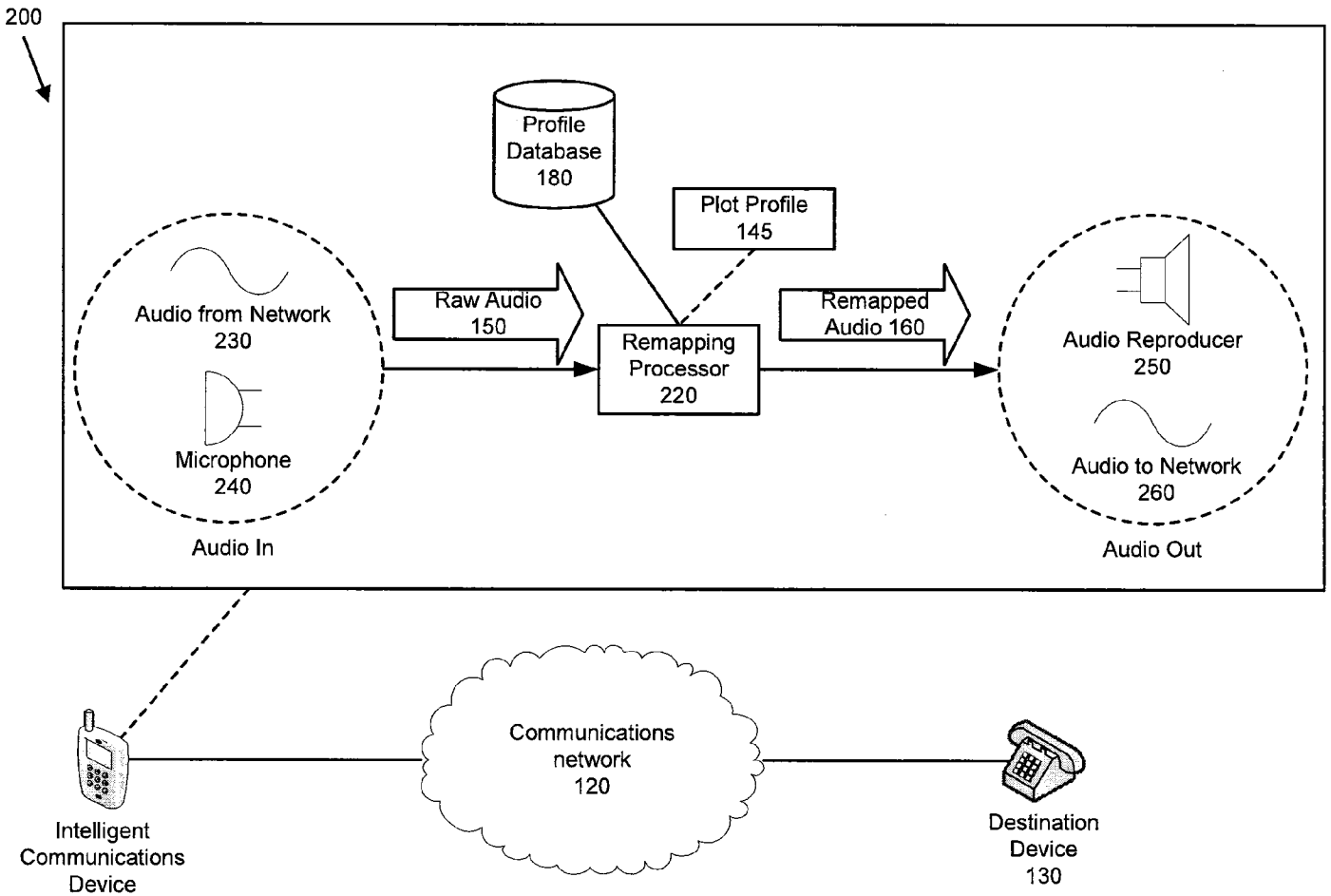
FIG. 2 illustrates an exemplary communications system including an intelligent communications device configured to remap a raw audio signal based on a plot profile.

FIG. 2 illustrates an exemplary communications system (system) 200 including an intelligent communications device 210 configured to remap a raw audio 150 signal based on a plot profile 145.

An intelligent communications device 210 (e.g. cellular phone, "softphone," wired handset, etc.) is a communication device configured to perform audio signal remapping within the intelligent communications device 210 itself. An intelligent communications device 210 may operate on a communications network 120 and perform audio signal remapping without regard to whether the communications network 120 includes facilities for remapping raw audio 150 signals.

Intelligent communications device 210 includes a remapping processor 220 to perform the remapping function. The remapping processor 220 processes a raw audio 150 signal into a remapped audio 160 signal, similar to remapping server 140 discussed above with regard to FIG. 1. In many examples, the remapping processor 220 is a computing device, including a processor, and storage. In general, a processor (e.g., a microprocessor) receives instructions, e.g., from a memory, a computer-readable medium, etc., and executes these instructions, thereby performing one or more processes, including one or more of the processes described herein. Such instructions may be stored and transmitted using a variety of known computer-readable media.

The remapping processor 220 may be used to process raw audio 150 signals received from a communications network 120 or to process raw audio 150 signals received from a user of intelligent communications device 210. The intelligent communications device 210 may further include at least one plot profile 145 for use by the remapping processor 220, and may optionally include a profile database 180 for the selective storage and retrieval of plot profiles 145.

For example, in a situation where a user has a hearing impairment, audio from network 230 can be an input source to be routed as raw audio 150 into the remapping processor 220. In this case, a plot profile 145 including a user's specific hearing range and impairments may be used by the remapping processor 220 to process raw audio 150 into remapped audio 160. Then, the remapped audio 160 may be routed to an audio reproducer 250, typically included within the intelligent communications device 210, so that the remapped audio 160 may be heard by the user.

In a further example, a microphone 240 may be included in the intelligent communications device 210 and used as a source of a raw audio 150 signal. In a case where a user has a voice of very high or low frequency, a plot profile 145 may be used to process the raw audio 150 into a remapped audio 160 signal of a more acceptable frequency range, e.g. to improve voice recognition for an auto-attendant system indicated as a destination device 130. Thus, remapped audio 160 may be output as audio to network 260 and sent on to communications network 120.

Figure 3A:
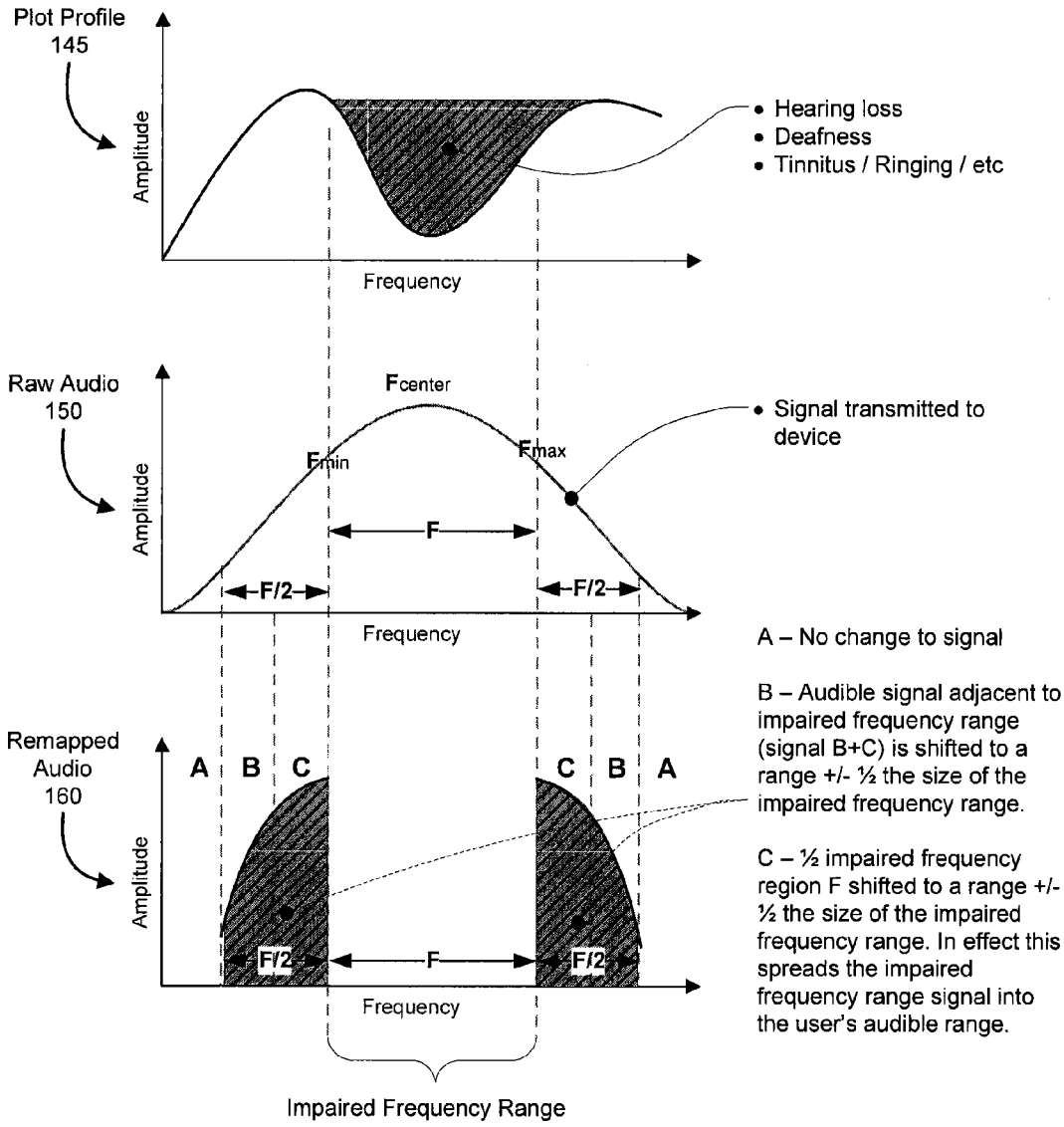
FIG. 3A illustrates an exemplary frequency remapping and compression for a plot profile including one impaired frequency range.

FIG. 3A illustrates an exemplary frequency remapping and compression for a plot profile 145 including one impaired frequency range. Frequency remapping and compression may, for example, be used to remap frequencies around a user's impaired frequency ranges.

As mentioned above, a plot profile 145 may include at least one area of impaired frequency response. When utilizing a frequency remapping and compression function, for each area of impaired frequency response, the sounds within the impaired area may be compressed in frequency and shifted in frequency to outside of the area of impairment. Additionally, frequencies adjacent to the impaired frequency range may be compressed and shifted in order to allow for the sounds within the impaired range to be moved out of the impaired range without overlap of any unimpaired frequency range.

As illustrated in FIG. 3A, a raw audio 150 signal may be divided into several regions of interest:

a. A=Region where no change to the audio signal is made;
b. B=Audible signal adjacent to range C;
c. C=Audible signal adjacent to the impaired range; and
d. F=Impaired range of frequencies.

As further illustrated in FIG. 3A, the raw audio 150 signal may be processed into a remapped audio 160 signal, such that:

a. A=Contains the same audio data as before processing;
b. B=Contains the signal from regions B+C of raw audio 150 signal;
c. C=Contains the signal from the impaired audio range of raw audio 150 signal; and
d. F=Empty range, no signal remaining.

Note that these regions are only exemplary and other examples with different regions of interest are possible.

An exemplary remapping system (e.g. including remapping processor 220, remapping server 140, etc.) may determine a minimum frequency ($F_{min}$), a maximum frequency ($F_{max}$), and a center frequency ($F_{center}$) of an impaired frequency range, based on the selected plot profile 145, where:

a. $F=F_{total}$=the impaired frequency range, in total;
b. $F_{center}$=the center frequency of the impaired range;
c. $F_{min}=(F_{center}-\frac{1}{2}F_{total})$; and
d. $F_{max}=(F_{center}+\frac{1}{2}F_{total})$.

In other examples, $F_{min}$, $F_{center}$, and $F_{max}$ may be calculated differently. For example, the calculation of $F_{center}$ may be omitted, and all of the frequencies within region F may be shifted downward, or all shifted upward. Alternately, $F_{center}$ may be calculated, not based on a center of the frequency range, but instead based on the content of a raw audio 150 signal itself (e.g. center of distribution of sound energy, logical break in the distribution of sound energy, etc.), based on a preset value, etc.

As illustrated in FIG. 3A, the system may compress the lower half of the input signal from $F_{min}$ up to $F_{center}$ downward into the user's unimpaired hearing range, and the upper half of the input signal from $F_{center}$ up to $F_{max}$ upward into the user's unimpaired hearing range. Frequencies already within the range adjacent to the impaired hearing range may also be compressed, so the entire remapping of both the impaired frequency range $F_{total}$, and the target remap ranges (e.g. from [½F below $F_{min}$] and [½F above $F_{max}$]) are placed into frequency ranges from [$F_{min}-\frac{1}{2}F$ to $F_{min}$], and [$F_{max}$ to $F_{max}+\frac{1}{2}F$], respectively.

The region outside of the ranges of [$F_{min}-\frac{1}{2}F$ to $F_{min}$], [$F_{min}$ to $F_{max}$], and [$F_{max}$ to $F_{max}+\frac{1}{2}F$] are represented in FIG. 3 as region A.

Additionally, regions of [$F_{min}-\frac{1}{2}F$ to $F_{min}-\frac{1}{4}F$] and [$F_{max}+\frac{1}{4}F$ to $F_{max}+\frac{1}{2}F$] are calculated. These regions are labeled as region B in FIG. 3.

Similarly, regions [$F_{min}-\frac{1}{4}F$ to $F_{min}$] and [$F_{max}$ to $F_{max}+\frac{1}{4}F$] are calculated, labeled as region C in FIG. 3.

No changes are made to the signal in region A of the raw audio 150 signal in the remapped audio 160 signal. Thus, sounds within region A are unaffected by the frequency compression or shifting operations. However, changes are made to the signal within regions B, C, and F.

In the raw audio 150 signal, regions B and C include the audible signal adjacent to the inaudible range F. In the remapped audio 160 signal, the signal as contained in the raw audio in both regions B and C may be compressed (in this example compressed in a ratio of 2:1) into a narrower frequency range (in this example a range of ½ size), and pitch shifted to occupy only range B of the remapped audio 160 signal.

Additionally, inaudible region F may be compressed (in this example compressed in a ratio of 2:1) into a narrower frequency range (in this example a range of ½ size), and pitch shifted to occupy region C. The lower half of region F may be shifted downward to occupy the entire lower region C, and the upper half of region F may be shifted upward to occupy the entire upper region C.

In the remapped audio 160 signal, region F is empty. In effect, this approach spreads the inaudible signal within region F into the user's audible range. Additionally, this approach may be repeated for each area of impaired frequency range within a plot profile 145.

In other examples, only a portion of the audio signal within region F may be shifted to outside of region F. However, shifting the frequency of at least a portion of the impaired audio frequencies to outside of the identified range is required in order to, for example, make an audio signal more intelligible, or to shift a voice into a more acceptable frequency range.

In further examples, instead of or in addition to moving at least a portion of the impaired audio frequencies to outside of the identified range, at least a portion of the impaired audio frequencies may be copied from region F to outside of the impaired frequency range. In these examples, the audio from the impaired audio frequency frequencies may remain in region F and also appear again outside of region F.

Figure 3B:
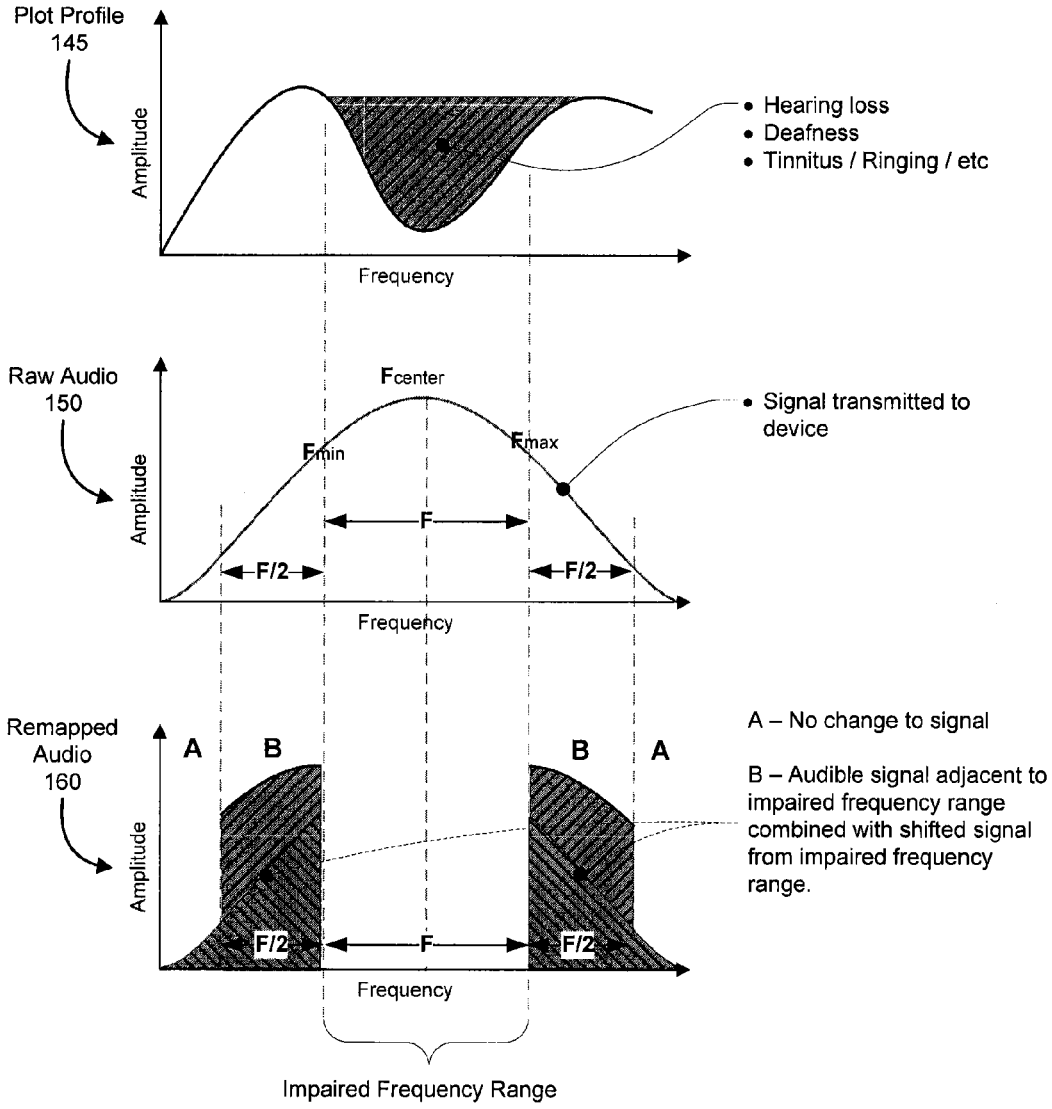
FIG. 3B illustrates an exemplary frequency remapping without compression for a plot profile including one impaired frequency range.

FIG. 3B illustrates an exemplary frequency remapping without compression for a plot profile 145 including one impaired frequency range.

When utilizing a frequency remapping function without compression, for each area of impaired frequency response, the sounds within the impaired area may be shifted in frequency to outside of the area of impairment, without being compressed in frequency. Additionally, instead of compressing and shifting frequencies adjacent to the impaired frequency range, frequencies inside the impaired frequency range may be mapped on top of frequencies adjacent to the impaired frequency range.

As illustrated in FIG. 3B, a raw audio 150 signal may be divided into several regions of interest:

a. A=Region where no change to the audio signal is made;
b. B=Audible signal adjacent to the impaired range; and
c. F=Impaired range of frequencies.

As further illustrated in FIG. 3A, the raw audio 150 signal may be processed into a remapped audio 160 signal, such that:

a. A=Contains the same audio data as before processing;
b. B=Contains the signal from regions B+F of raw audio 150 signal; and
c. F=Empty range, no signal remaining.

It is important to note that other remappings are possible, in addition to the exemplary frequency remapping as illustrated by FIGS. 3A and 3B. For example, frequencies inside the impaired frequency range may be mapped into a located area outside of any impaired audio range within the raw audio 150 signal where little or no sound energy exists. Or, remapping may be performed through shifting the frequency of an entire audio signal away from an impaired range, without compression. However, such an approach may potentially cause frequencies to be cut off at the ends of the device frequency range.

Figure 4:
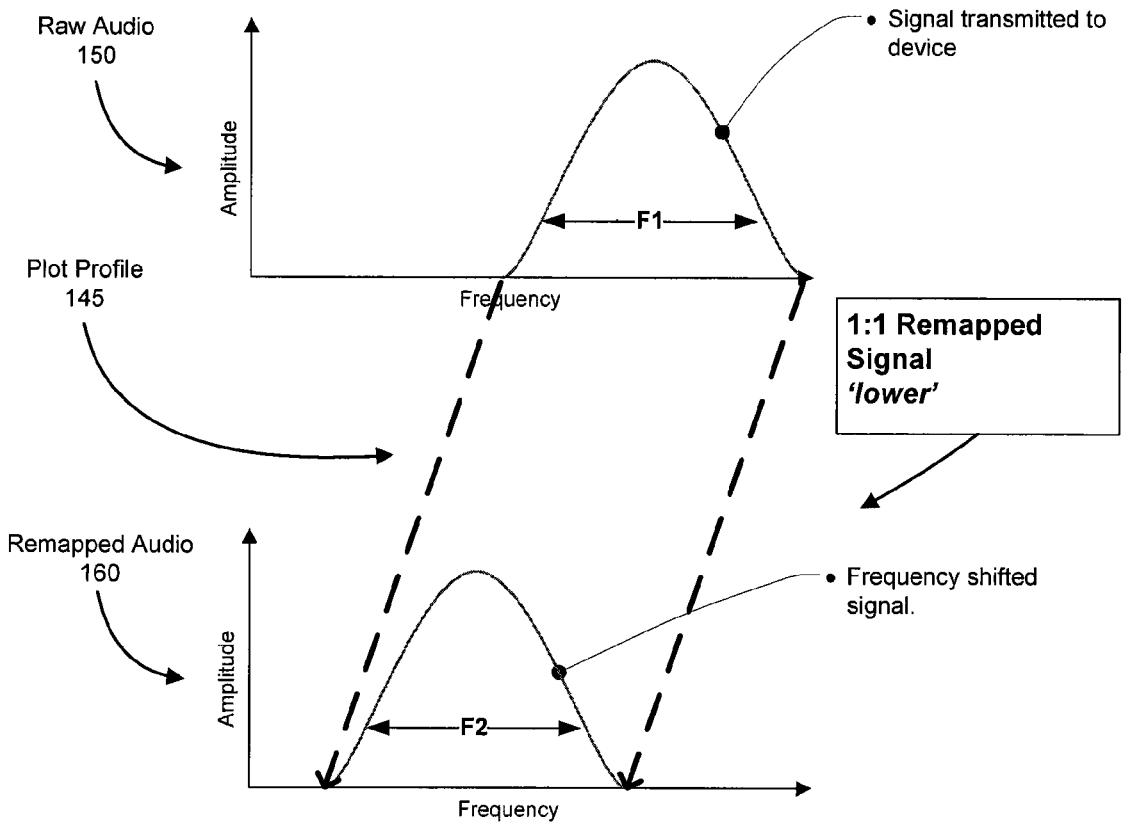
FIG. 4 illustrates an exemplary simple frequency shifting of a transmitted signal.

FIG. 4 illustrates an exemplary simple frequency shifting of a transmitted signal. Frequency shifting is typically used in cases where a simple direct pitch shift is appropriate, such as to shift frequencies of an unusually low or high pitched user's voice into a more acceptable frequency range for an auto-attendant system, as opposed to mapping around a range of hearing impairment.

As illustrated in FIG. 4, a raw audio 150 may include a signal at frequency F1. In a remapped audio 160 signal, frequency F1 may be shifted downward in frequency to frequency F2. In contrast to the approach as described above with regard to FIG. 3, the signal in FIG. 4 is not compressed. Instead, the signal may be remapped in a 1:1 ratio.

Figure 5:
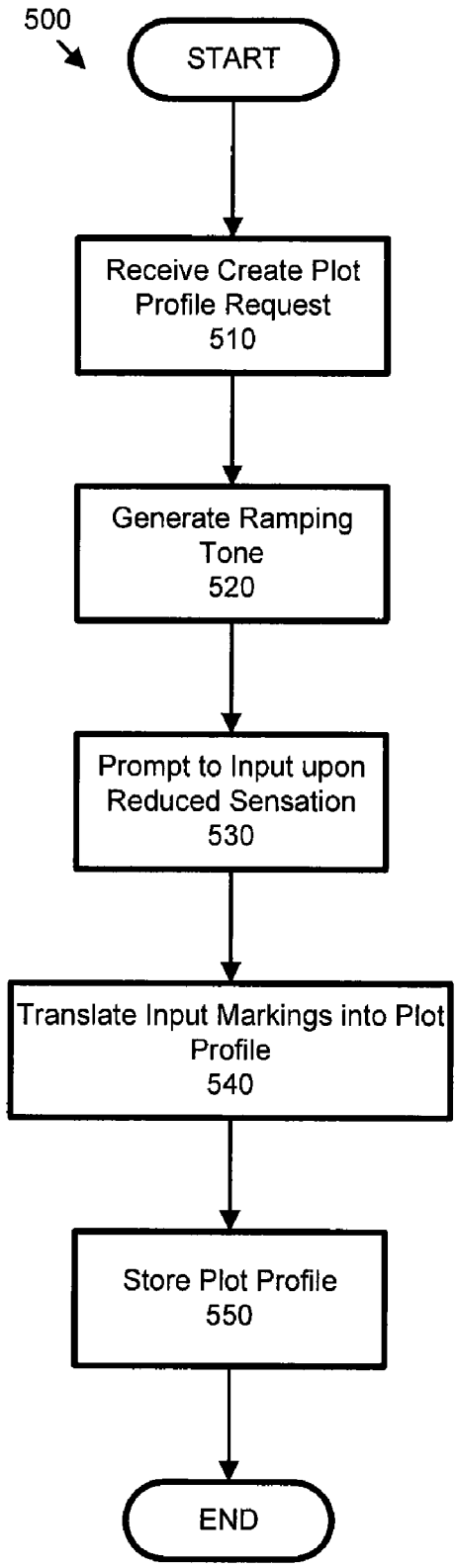
FIG. 5 illustrates an exemplary process for creating a plot profile describing a user's impaired frequency ranges.

FIG. 5 illustrates an exemplary process 500 for creating a plot profile 145 describing a user's impaired frequency ranges.

In step 510, a request to create a plot profile 145 may be received by a device on a communications network 120, (e.g. attendant front end 190, profile server 170, etc.). Alternately, an intelligent communications device 210 may receive a request to create a plot profile 145 without regard to a communications network 120, for example through use of a user interface of intelligent communications device 210.

Next, in step 520, a ramping tone may be generated. For example, the handset may generate a ramping tone that covers the entire audio spectrum within its limits (i.e. from ~50 hz to 8 Khz for a standard PCM telephone range, or wider for a more responsive devices such as an MP3 player, etc., with a more extended range up to 20 KHz, the human hearing limit, etc.).

Next, in step 530, the user may be prompted to input upon reduced sensation (i.e. the user cannot hear the tone or hears the tone with decreased response). For example, a function on an intelligent communications device 210 may prompt a user (e.g. by audio, by visual cues on the screen, audio and visual cues combined, etc.) to input when the user experiences reduced sensation by pressing a button on the device. The user may also release the button when again able to hear the signal. In other examples, the user may press a button when hearing the tone and release when experiencing reduced sensation, respond by speaking, press 1 for an audible tone and press 2 for an inaudible tone, and so on.

In still other examples, the user may be presented with an individual tone, and then prompted for a response with regard to the test tone's audibility. This process of presentation of tones and prompting for responses may thus be repeated for various tones or portions of the ramping tone throughout the system or device range.

Next, in step 540, the user input may be translated into a plot profile 145. The user-frequency markings, as collected in responses to the tones in step 530, thus may be translated into a plot profile 145 including the user's hearing impairments.

Next, in step 550, the plot profile 145 may be stored, possibly with a tag providing information on the specific environment at issue such as a factory shop floor. The plot profile 145 may be stored on an intelligent communications device 210 (e.g. in device memory, in a profile database 180 local to the device, etc.), and/or on a communications network (e.g. on a profile server 170, in a profile database 180, etc.). Then, the process 500 ends.

Figure 6:
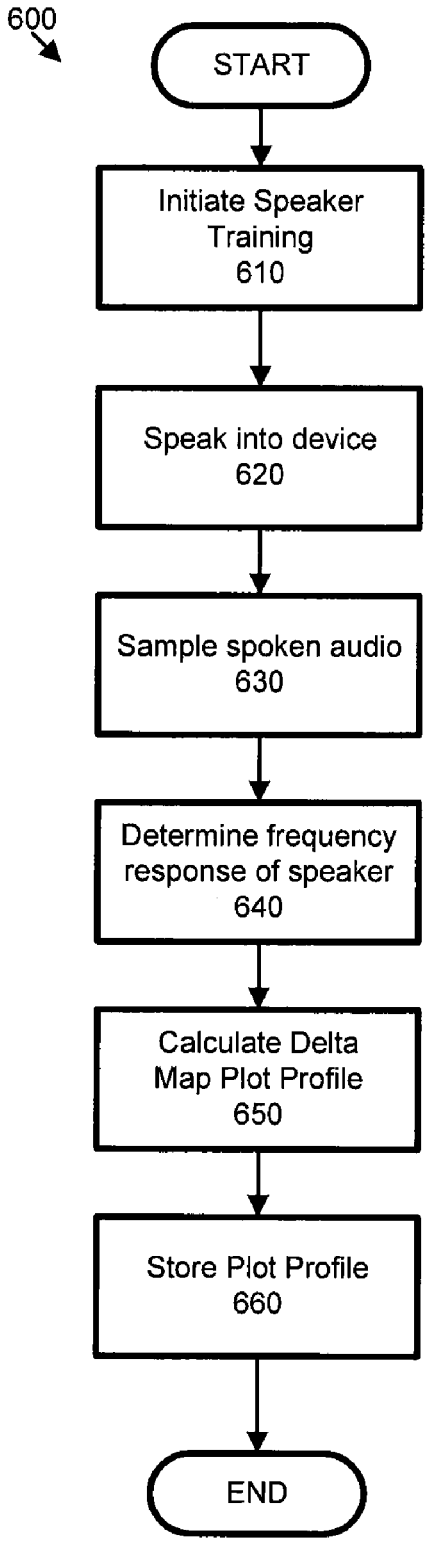
FIG. 6 illustrates an exemplary process for creating a plot profile for a speaker's vocal output.

FIG. 6 illustrates an exemplary process 600 for creating a plot profile 145 for a user's vocal output. Such a plot profile 145 may be used, for example, to remap raw audio 150 including speech of a user with a very high voice into a more acceptable frequency range for an auto-attendant system.

In step 610, speaker training of a user is initiated. For example, speaker training may be initiated automatically, (e.g. upon first use of a device), or by a user request (e.g. through a user interface of an intelligent communications device 210, through a user request to an attendant front end 190 or profile server 170, etc.).

Next, in step 620, the user may speak into a sound capture component of a device (e.g. microphone 240 of an intelligent communications device 210, etc.). The device may be a communications device 110 such as a POTS telephone, VOIP telephone, cellular/mobile telephone, "softphone," etc., or another device. The device may be an intelligent communications device 210. In this step, the user may speak into the device (e.g., for a period of time, until completing a speech exercise, etc.).

Next, in step 630, the captured audio spoken by the user may be sampled. In this step, the device may sample the spoken audio. In other examples, another device on the communications network 120 (e.g. attendant front end 190, profile server 170, etc.) may perform the sampling of captured spoken audio.

Next, in step 640 the frequency response of the user's voice may be determined. In this step, the device may determine the complete frequency response of the user's voice. In other examples, another device on the communications network 120 (e.g. attendant front end 190, profile server 170, etc.) may perform the comparison or calculations.

Next, in step 650, the frequency markings calculated in step 640 may be converted into a plot profile 145 representing the user's input data plot profile. For example, the device may compare a frequency plot of the user's voice to a predefined standard/industry vocal plot, and may calculate an appropriate delta to remap the spoken input into these standard plots. This delta may be included in a plot profile 145, and the plot profile 145 may be used to remap the user's outbound audio (e.g., raw audio 150), i.e. to shift the audio into conformity with the standard/industry vocal plot.

Next, in step 660, the plot profile created in step 650 may be stored, possibly with a tag providing information on the specific environment at issue such as a factory shop floor. The plot profile 145 may be stored on an intelligent communications device 210 (e.g. in device memory, in a profile database 180 local to the device, etc.), and/or may be stored on a communications network (e.g. on profile server 170, in profile database 180, etc.). Then, the process 600 ends.

Figure 7:
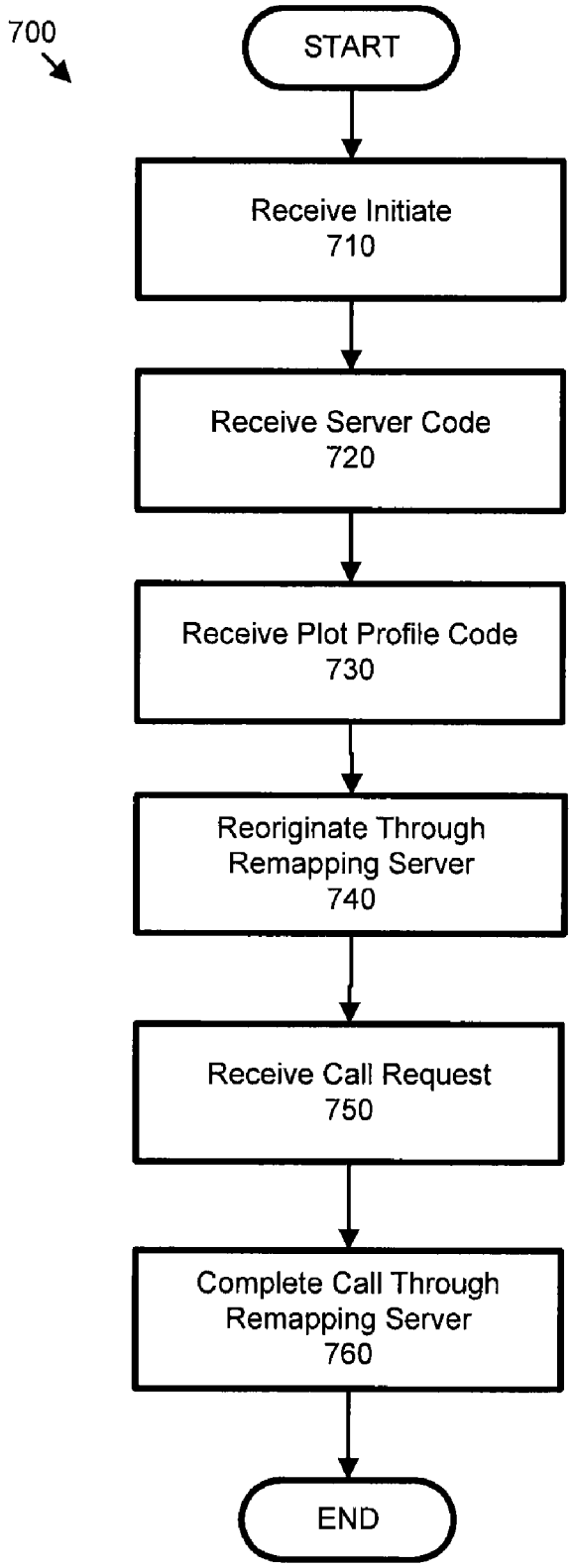
FIG. 7 illustrates an exemplary process for selecting a plot profile.

FIG. 7 illustrates an exemplary process 700 for selecting a plot profile 145.

In step 710, an initiate signal may be received. For example, a user may signal through a communications device 110 to indicate the initiation of a request to connect to a destination device 130.

Next, in step 720, a server code may be received. For example, a user may dial a specific code (e.g. "*3324") to connect to a remapping server 140 or an attendant front end 190.

Next, in step 730, a plot profile 145 code may be received. For example, a user may then dial a plot profile code (e.g. "2") to activate a specific plot profile 145 (stored, e.g., on a profile server 170, in a profile database 180, etc.). In the case of a communications network 120 such as system 200 (i.e., including an intelligent communications device 210), a user may select a plot profile 145 stored on the intelligent communications device 210 or on another device connected to communications network 120 (e.g. profile server 170, profile database 180, etc.).

Next, in step 740, a call request may be reoriginated through a remapping server 140. For example, a dial tone may be reoriginated through a remapping server 140 on a communications network 120.

Next, in step 750, a call request may be received. For example, a user may dial a specific code indicating a destination device 130 (e.g. "555-1234").

Next, in step 760, a call is completed through the remapping server 140. In this way, a remapping server 140 may map raw audio 150 into remapped audio 160 on a communications network 120 based on a selected plot profile 145. The selected plot profile 145 may remain in effect for the duration of the call, or may be persistent and remain in effect by default for subsequent calls. Then, process 700 ends.

Figure 8:
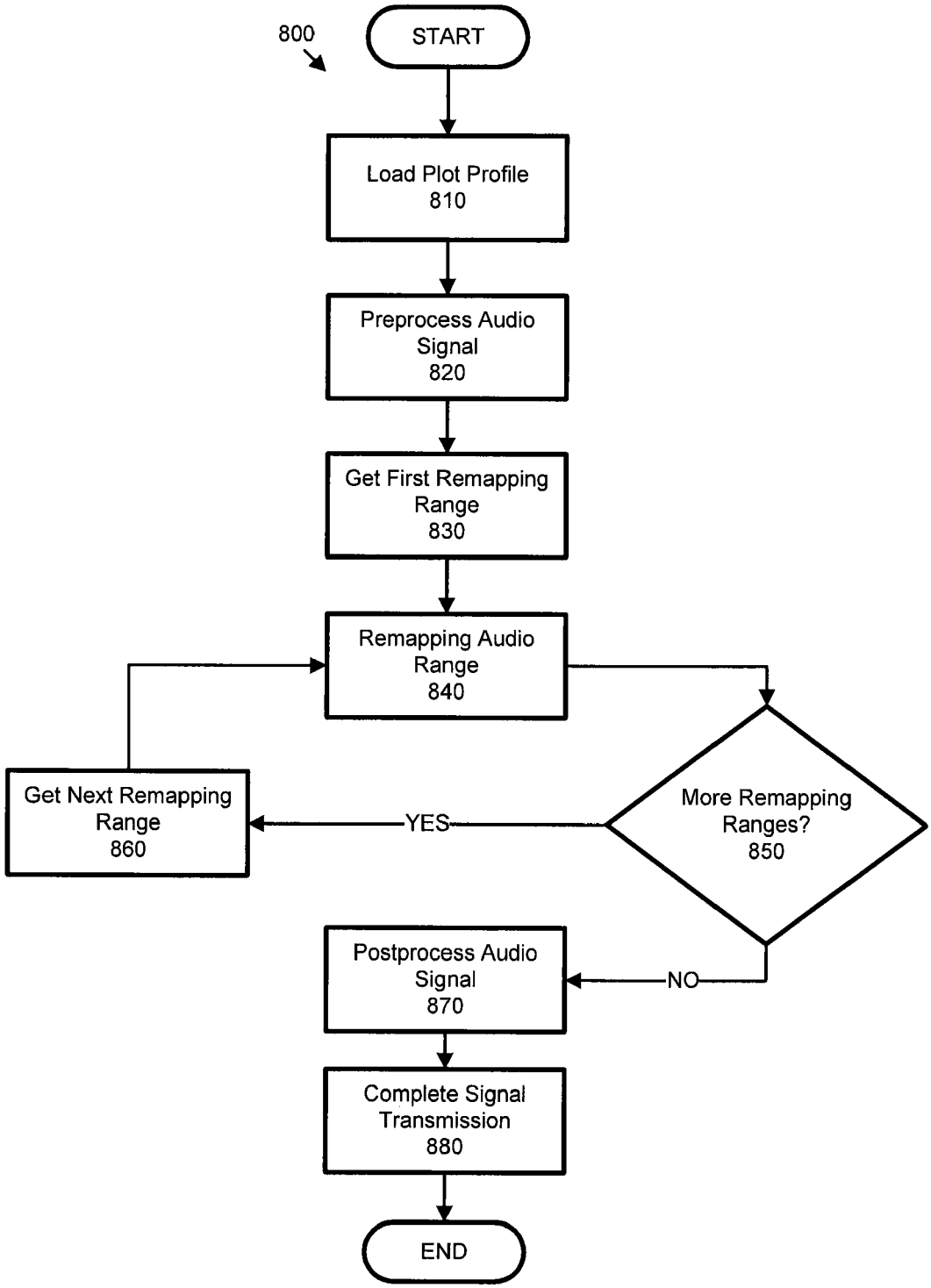
FIG. 8 illustrates an exemplary process for remapping a raw audio signal into a remapped audio signal based on a plot profile.

FIG. 8 illustrates an exemplary process 800 for remapping a raw audio 150 signal into a remapped audio 160 signal based on a plot profile 145.

In step 810, a plot profile 145 is loaded. In some examples, a plot profile 145 is automatically associated with a device or system. In other examples, a plot profile 145 may be selected as discussed above with regard to FIG. 7. In still other examples, a user may select a plot profile 145 stored on an intelligent communications device 210 through a user interface on the intelligent communications device 210.

Next, in step 820, preprocessing of the audio signal may be performed. As mentioned above, a communications network 120 may utilize analog audio signals or digital audio signals. In the case of a communications network 120 utilizing analog signals, a raw audio 150 signal may be translated into a digital audio signal for processing (e.g. via PCM, ADPCM, etc.). Additionally, audio signals may be further processed for more effective remapping (e.g. normalization, dynamic range compression, filtering, frequency cutoffs, etc.).

Next, in step 830, a first remapping range in the active plot profile 145 may be retrieved. As discussed above, a plot profile 145 may contain at least one remapping range.

Next, in step 840, the raw audio 150 signal may be remapped based on the remapping range. The remapping for the remapping range may include frequency remapping and compression as discussed above with regard to FIG. 3, or frequency shifting as discussed above with regard to FIG. 4.

Next, in step 850, it may be determined if the plot profile 145 includes any more remapping ranges. If yes, step 860 is executed next. Otherwise, step 870 is executed.

In step 860, a next remapping range may be retrieved from the plot profile 145, and therefore step 840 is executed next to remap the audio for the next remapping range.

In step 870, post processing is performed on the remapped audio 160 signal. In the case of a communications network 120 utilizing analog signals, the remapped audio 160 signal may be translated back into an analog audio signal for further transmission through the communications network (e.g. POTS, etc.). Additionally, the audio signal may be further processed to remove any artifacts of the remapping process, (e.g. normalization, dynamic range compression, filtering, frequency cutoffs, etc.).

Next, in step 880, the remapped audio 160 signal may be continued to be routed through the communications network 120, as is known. Then, the process 800 ends.

CONCLUSION

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A method, comprising:

receiving a plot profile including at least one of an identified range of audio frequencies;

receiving an audio signal; and processing the audio signal into a remapped audio signal using the plot profile, the processing comprising:

retrieving an identified range of audio frequencies from the plot profile;

determining a range of impaired audio frequencies in the audio signal based on the identified range of audio frequencies;

determining a minimum frequency, a maximum frequency, and a center frequency of the impaired frequency range;

shifting the frequency of at least a subset of a lower portion of the impaired audio frequencies from the minimum frequency up to the center frequency downward to outside of the identified range;

shifting the frequency of at least a subset of a higher portion of the impaired audio frequencies from the center frequency up to the maximum frequency upward to outside of the identified range; and continuing to retrieve identified ranges of audio frequencies from the plot profile, and shifting the impaired audio frequencies of the audio signal, until no further identified ranges of audio frequencies are available for consideration.

2. The method of claim 1, wherein processing the audio signal further comprises compressing in frequency range at least a portion of the impaired audio frequencies in the audio signal.

3. The method of claim 2, wherein the frequency range compression ratio of uncompressed frequency range to compressed frequency range is approximately 2:1.

4. The method of claim 2, wherein processing the audio signal further comprises:

determining a range of audio frequencies adjacent to the impaired audio frequency range in the audio signal based on the identified range;

compressing in frequency at least a portion of the range of audio frequencies adjacent to the impaired audio frequency range; and shifting at least a portion of the range of adjacent audio frequencies below the minimum frequency downward in frequency, and shifting at least a portion of the range of adjacent audio frequencies above the maximum frequency upward in frequency, to allow for the audio frequencies within the impaired range to be moved out of the impaired range without overlapping the adjacent frequency range.

5. The method of claim 1, wherein the center frequency is defined according to at least one of: a center of the frequency range, a center of distribution of sound energy of the audio signal, and a logical break in a distribution of sound energy of the audio signal.

6. The method of claim 1, further comprising:

receiving the audio signal over a communications network from a first communications device; and providing the remapped audio signal over the communications network to a second communications device.

7. A method, comprising:

receiving a plot profile including at least one data element;

receiving an audio signal;

retrieving a data element from the plot profile;

processing the audio signal into a remapped audio signal using the data element, including:

retrieving an identified range of audio frequencies from the data element;

determining a range of impaired audio frequencies in the audio signal based on the identified range of audio frequencies;

determining a minimum frequency, a maximum frequency, and a center frequency of the impaired frequency range;

shifting and compressing the frequency of at least a subset of the lower portion of the input signal from the minimum frequency up to the center frequency downward to outside of the impaired frequency range;

shifting and compressing the frequency of at least a subset of the upper portion of the input signal from the center frequency up to the maximum frequency upward to outside of the impaired frequency range; and continuing to retrieve data elements from the plot profile, and processing the audio signal, until no further data elements are available for consideration.

8. The method of claim 7, wherein each of the at least one data element comprises a range of audio frequencies, and wherein processing the audio signal into a remapped audio signal comprises:

determining a range of audio frequencies adjacent to the impaired audio frequency range in the audio signal based on the identified range;

compressing in frequency at least a portion of the range of audio frequencies adjacent to the impaired audio frequency range; and shifting at least a portion of the range of adjacent audio frequencies below the minimum frequency downward in frequency, and shifting at least a portion of the range of adjacent audio frequencies above the maximum frequency upward in frequency, to allow for the audio frequencies within the impaired range to be moved out of the impaired range without overlapping the adjacent frequency range.

9. The method of claim 7, wherein each of the at least one data element comprises a preset frequency offset, and wherein processing the audio signal into a remapped audio signal comprises shifting the frequency of at least a portion of the audio signal according to the preset frequency offset.

10. The method of claim 7, wherein the at least one data element comprises at least one of a range of audio frequencies and a preset frequency offset, and wherein processing the audio signal into a remapped audio signal comprises:

determining whether the data element includes at least one of a range of impaired audio frequencies;

if the data element includes a range of impaired audio frequencies:

determining a range of audio frequencies adjacent to the impaired audio frequency range in the audio signal based on the identified range;

compressing in frequency at least a portion of the range of audio frequencies adjacent to the impaired audio frequency range; and shifting at least a portion of the range of adjacent audio frequencies below the minimum frequency downward in frequency, and shifting at least a portion of the range of adjacent audio frequencies above the maximum frequency upward in frequency, to allow for the audio frequencies within the impaired range to be moved out of the impaired range without overlapping the adjacent frequency range; and if the data element is a preset frequency offset, shifting the frequency of at least a portion of the audio signal according to the preset frequency offset.

11. The system of claim 10, wherein the plot profile is received based on a tag providing information on a specific environment at issue.

12. A system, comprising:

a processing device including at least one processor and a computer readable medium having instructions configured to cause the processor to:

receive an audio signal; and process the audio signal into a remapped audio signal based on a plot profile, the plot profile including at least one of an identified range of audio frequencies, the processing comprising:

retrieving an identified range of audio frequencies from the plot profile;

determining a range of impaired audio frequencies in the audio signal based on the identified range of audio frequencies;

determining a minimum frequency, a maximum frequency, and a center frequency of the impaired frequency range;

shifting the frequency of at least a subset of a lower portion of the impaired audio frequencies from the minimum frequency up to the center frequency downward to outside of the identified range;

shifting the frequency of at least a subset of a higher portion of the impaired audio frequencies from the center frequency up to the maximum frequency upward to outside of the identified range; and continuing to retrieve identified ranges of audio frequencies from the plot profile, and shifting the impaired audio frequencies of the audio signal, until no further identified ranges of audio frequencies are available for consideration.

13. The system of claim 12, further comprising:

a communications network configured to provide communication services to a plurality of communication devices; and a plurality of communications devices connected to the communications network;

wherein the processing device is connected to the communications network and further comprises additional instructions to cause the processor to perform as a communications device on the communications network.

14. The system of claim 12, further comprising:

a communications network configured to provide communication services to a plurality of communication devices;

a profile server comprising a profile database including at least one plot profile, wherein the profile server is configured to selectively provide plot profiles to the processing device; and a plurality of communications devices connected to the communications network;

wherein the processing device is connected to the communications network and further comprises additional instructions to cause the processor to:

receive an audio signal over the communications network from a first of the plurality of communications devices;

receive a plot profile from the profile server; and send the remapped audio signal over the communications network to a second least one of the plurality of communications devices.

15. The system of claim 14, further comprising an attendant front end, configured to:

provide a user interface for plot profile selection to at least one of the plurality of communications devices;

receive input from at least one of the plurality of communications devices indicating a plot profile selection;

inform a profile server to selectively retrieve a plot profile; and indicate the plot profile selection to a remapping server.

16. The system of claim 12, wherein the plot profile includes a predefined standard industry profile.

17. The system of claim 12, wherein the audio signal is an analog signal, and wherein the processing device further comprises additional instructions to cause the processor to:

translate the analog audio signal into a digital audio signal before processing the audio signal into a remapped audio signal; and translate the digital audio signal back into an analog signal after processing the audio signal into a remapped audio signal.

18. A system, comprising:

a processing device including at least one processor and a computer readable medium having instructions configured to cause the processor to:

initiate a training mode;

receive input from a communications device to create a plot profile according to the training mode;

determine a range of impaired audio frequencies based on the input received in the training mode;

generate the plot profile based upon the determined range of impaired frequencies, the plot profile including information configured to process an audio signal into remapped audio, the processing of audio including to:

determine a minimum frequency, a maximum frequency, and a center frequency of the impaired frequency range;

shift the frequency of at least a subset of a lower portion of the impaired audio frequencies from the minimum frequency up to the center frequency downward to outside of the identified range;

shift the frequency of at least a subset of a higher portion of the impaired audio frequencies from the center frequency up to the maximum frequency upward to outside of the identified range; and store the plot profile.

19. The system of claim 18, wherein the plot profile is stored on the processing device.

20. The system of claim 18, wherein the plot profile is stored with a tag providing information on a specific environment at issue.

21. The system of claim 18, further comprising:

a communications network configured to provide communication services to a plurality of communication devices; and a plurality of communications devices connected to the communications network;

wherein the processing device is connected to the communications network and further comprises additional instructions to cause the processor to:

receive an audio signal over the communications network from a first of the plurality of communications devices;

selectively access a stored plot profile stored on the processing device;

process the audio signal into a remapped audio signal based on the plot profile; and send the remapped audio signal over the communications network to a second least one of the plurality of communications devices.

22. The system of claim 21, further comprising:

a profile server comprising a profile database;

wherein the processing device further comprises additional instructions to cause the processor to transmit at least one plot profile to the profile server for storage in the profile database.

23. The system of claim 18, wherein the standard plot profile includes a standard frequency response of a speaker's voice.

24. The system of claim 21, wherein the at least one of the plurality of communications devices other than the first one of the plurality of communications devices includes an automatic attendant system, and the plot profile is configured to process the raw audio into a remapped audio signal to improve voice recognition of the automatic attendant system.

* * * * *